United States Patent [19]

Janssen

[11] Patent Number: 4,913,257

[45] Date of Patent: Apr. 3, 1990

[54] ELECTRICALLY DRIVEN WHEELCHAIR WITH WORKTOP AND CONTROL UNIT

[75] Inventor: Henricus T. J. Janssen, Oldenzaal, Netherlands

[73] Assignee: Huka Developments B.V., Oldenzaal, Netherlands

[21] Appl. No.: 261,727

[22] Filed: Oct. 24, 1988

[30] Foreign Application Priority Data

Oct. 29, 1987 [NL] Netherlands ..... 8702583

[51] Int. Cl.[4] ..... A61G 5/04

[52] U.S. Cl. ..... 180/333; 180/334; 180/907; 280/304.1; 312/22

[58] Field of Search ..... 180/315, 326, 333, 334, 180/907; 312/22, 25, 30; 280/304.1

[56] References Cited

U.S. PATENT DOCUMENTS 4,323,829 4/1982 Witney ..... 318/55
4,415,049 11/1983 Wereb ..... 180/907
4,632,451 12/1986 Lee ..... 280/304.1

FOREIGN PATENT DOCUMENTS 978617 4/1951 France ..... 312/22

*Primary Examiner*—Kenneth R. Rice
*Attorney, Agent, or Firm*—Allegretti & Witcoff, Ltd.

[57] ABSTRACT

Electrically driven wheelchair with an essentially horizontal worktop (7) and a control unit (1) connected thereto, said control unit in the operational position fits into a corresponding aperture in the worktop and is connected to the worktop in such a way that it pivots and slides in a horizontal plane, and after pivoting and sliding the bottom side of the control unit fills the gap in the worktop.

1 Claim, 1 Drawing Sheet

ELECTRICALLY DRIVEN WHEELCHAIR WITH WORKTOP AND CONTROL UNIT

Figure 1:
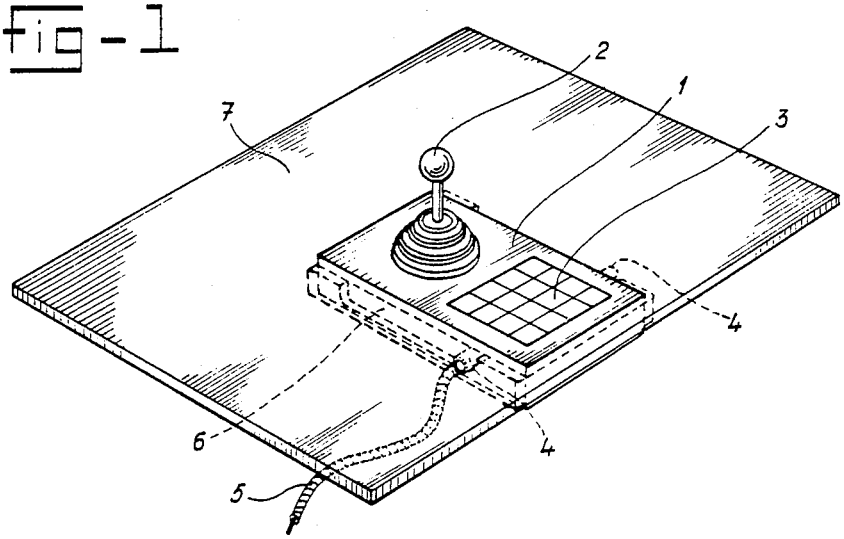

The invention relates to an electrically driven wheelchair with an essentially horizontal worktop and a control unit connected thereto. Such wheelchairs are known.

A wheelchair with the control unit on, in or under the worktop is mainly used for wheelchair users with very limited hand/arm function and limited trunk stability.

The wheelchair is used for all kinds of purposes, such as eating and drinking, holding books, toys, learning material etc.

It will be clear that the control unit constitutes an obstacle for the functioning of the worktop if the unit projects beyond the surface of the worktop, even if the control unit can be pushed away from the user over the worktop.

It has also been proposed that the control button should be made removable and that the control unit should be disposed under the worktop.

After removal of the button, the gap in the worktop can be covered with a loose cover piece.

All these solutions have disadvantages, such as inconvenient position and thus operation of the unit, and many actions are needed to clear the worktop.

The object of the invention is to eliminate these disadvantages, and this is achieved in that the control unit in the operational position fits into a corresponding aperture in the worktop and is connected to the worktop in such a way that it pivots about a horizontal axis.

With this measure the control unit can be pivoted to the non-operational position.

However, the gap in the worktop must then be closed with a separate cover piece.

It is therefore preferable for the control unit to be connected to the worktop in such a way that it not only pivots but also slides in a horizontal plane, and after pivoting and sliding the bottom side of the control unit fills the gap in the worktop.

In this way the control unit can be pivoted through 180 degrees, through the fact that the pivot pin can move parallel to itself. In the non-operational position the unit thus lies upside down in the gap.

The pivot pin is preferably fixed in the control unit near one of the ends thereof.

While it is being flipped over, the control unit thus does not project from under the worktop, which means that the legs of the wheelchair user are not obstructed.

In order to obtain a smooth working surface in the non-operational position of the control unit, it is preferable for the bottom side of the control unit in the non-operational position to lie flush with the top surface of the worktop.

Figure 2:
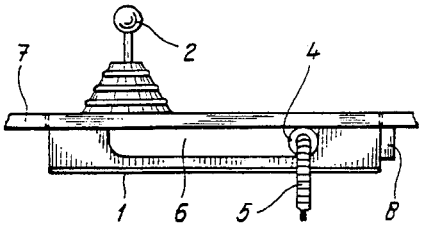
Figure 3:
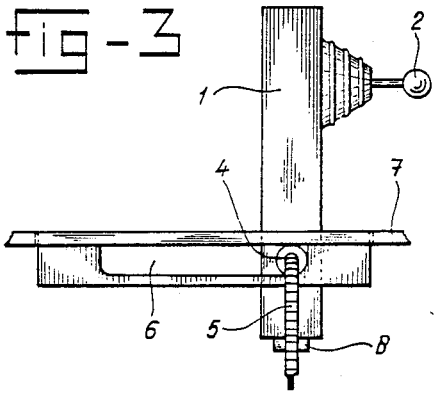
Figure 4:
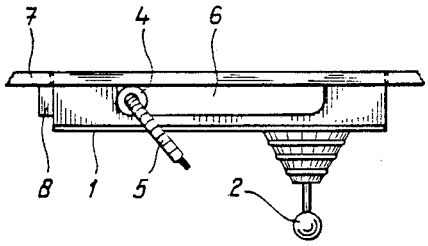

The invention will be explained in greater detail with reference to the drawing, in which:

FIG. 1 is a perspective view of a worktop containing the control unit in the operational position, and FIGS. 2, 3 and 4 show a side view of the control unit in various positions.

The control unit 1 is preferably a rectangular shape in top view.

This control unit 1 comprises a control handle 2 and a number of switches for ON/OFF, light, horn, direction indicators and the like.

Two pivot pins 4, at least one of which is hollow for passing through an umbilical cord 5, project laterally near one end of the unit 1.

These pivot pins 4 can slide into two slots 6 under the worktop 7.

Lobes 8 at the end of the unit 1 hold the top face of the unit 1 in the operational position and the bottom face of the unit 1 in the non-operational position flush with the top face of the worktop 7.

FIG. 2 shows the control unit 1 in the operational position, accommodated in a suitable aperture in the worktop 7.

In FIG. 3 the control unit 1 is on the way to the non-operational position, which is achieved in FIG. 4.

It can be seen from FIG. 3 that even in this intermediate position the unit 1 projects only slightly under the worktop 7. The legs of the wheelchair user are therefore not obstructed.

In FIG. 4 the bottom face of the control unit 1 is flush with the top face of the worktop 7.

The unit 1 is moved to the operational position in the reverse order.

I claim:

1. An electrically driven wheelchair comprising a horizontal work top, an opening in said work top at one side thereof, a smooth-bottomed control unit disposed in said opening having a control handle, said control handle projecting above the surface of said control unit at a point opposite said one side of the work top when the control unit is in operative position, a pair of elongated slots disposed at opposed sides of said opening, a pair of pins mounted on the control unit which pins extend into and slide in said slots, an umbilical cord connecting through one of said pins to said control unit, whereby said control unit can be inverted 180° by rotation about said pins to position said smooth bottom in the plane of said work top with said control handle projecting below the surface thereof adjacent said one side of said work top.

* * * * *